US005582534A

United States Patent [19]

Shendon et al.

[11] Patent Number: 5,582,534

[45] Date of Patent: Dec. 10, 1996

[54] ORBITAL CHEMICAL MECHANICAL POLISHING APPARATUS AND METHOD

[75] Inventors: Norm Shendon, San Carlos; Dennis R. Smith, Santa Clara County, both of Calif.

[73] Assignee: Applied Materials, Inc., Santa Clara, Calif.

[21] Appl. No.: 173,846

[22] Filed: Dec. 27, 1993

[51] Int. Cl.[6] ..... B24B 1/00; B24B 7/00

[52] U.S. Cl. ..... 451/41; 451/270; 451/288; 451/291

[58] Field of Search ..... 451/41, 270, 287, 451/288, 291

[56] References Cited

U.S. PATENT DOCUMENTS

| | | | |
|---|---|---|---|
| Re. 34,425 | 11/1993 | Schultz . | |
| 3,137,977 | 6/1964 | Graves . | |
| 3,156,073 | 11/1964 | Strasbaugh . | |
| 3,170,273 | 2/1965 | Walsh . | |
| 3,342,652 | 9/1967 | Reisman et al. . | |
| 3,559,346 | 2/1971 | Paola . | |
| 3,708,921 | 1/1973 | Cronkhite et al. | 451/288 |
| 3,748,790 | 7/1973 | Pizzarello et al. . | |
| 3,841,031 | 10/1974 | Walsh . | |
| 3,906,678 | 12/1975 | Roth . | |
| 3,962,832 | 6/1976 | Strasbaugh . | |
| 3,978,622 | 12/1976 | Mazur et al. . | |
| 3,986,433 | 10/1976 | Walsh et al. . | |
| 4,143,490 | 3/1979 | Wood . | |
| 4,239,567 | 12/1980 | Winings . | |
| 4,256,535 | 3/1981 | Banks . | |
| 4,257,194 | 3/1981 | Cailloux . | |
| 4,373,991 | 2/1983 | Banks . | |
| 4,380,412 | 4/1983 | Walsh . | |
| 4,525,954 | 7/1985 | Larsen . | |
| 4,653,231 | 3/1987 | Cronkhite et al. . | |
| 4,680,893 | 7/1987 | Cronkhite et al. . | |
| 4,831,784 | 5/1989 | Takahashi | 451/288 |
| 4,839,993 | 6/1989 | Masuko et al. . | |
| 4,873,792 | 10/1989 | Linke et al. | 451/288 |
| 4,918,870 | 4/1990 | Torbert et al. . | |
| 4,940,507 | 7/1990 | Harbarger . | |
| 4,944,836 | 7/1990 | Beyer et al. . | |
| 4,956,313 | 9/1990 | Cote et al. . | |
| 4,992,135 | 2/1991 | Doan . | |
| 4,996,798 | 3/1991 | Moore | 451/400 |
| 5,020,283 | 6/1991 | Tuttle . | |
| 5,036,015 | 7/1991 | Sandhu et al. . | |
| 5,064,683 | 11/1991 | Poon et al. . | |
| 5,069,002 | 12/1991 | Sandhu et al. . | |
| 5,081,796 | 1/1992 | Schultz . | |
| 5,114,875 | 5/1992 | Baker et al. . | |
| 5,169,491 | 12/1992 | Doan . | |
| 5,205,077 | 4/1993 | Wittstock | 451/8 |
| 5,205,082 | 4/1993 | Shendon et al. . | |
| 5,209,816 | 5/1993 | Yu et al. . | |
| 5,216,843 | 5/1993 | Breivogel et al. . | |
| 5,222,329 | 6/1993 | Yu . | |
| 5,225,034 | 7/1993 | Yu et al. . | |
| 5,232,875 | 8/1993 | Tuttle et al. . | |
| 5,234,867 | 8/1993 | Schultz et al. . | |
| 5,244,534 | 9/1993 | Yu et al. . | |
| 5,297,364 | 3/1994 | Tuttle . | |
| 5,302,233 | 4/1994 | Kim et al. . | |
| 5,333,413 | 8/1994 | Hashimoto | 451/287 |

FOREIGN PATENT DOCUMENTS

| | | |
|---|---|---|
| 0121707 | 10/1984 | European Pat. Off. . |
| 0593057 | 4/1994 | European Pat. Off. . |
| 3411120 | 11/1984 | Germany . |
| 4302067 | 1/1993 | Germany . |

OTHER PUBLICATIONS

Pp. 20 to 24 of EBARA CMP System Brochure.

*Primary Examiner*—Timothy V. Eley
*Attorney, Agent, or Firm*—Fish & Richardson, P.C.

[57] ABSTRACT

A process for polishing substrates includes a carrier which receives a substrate and positions it against a slowly rotating polishing pad. The carrier orbits the pad on the rotating pad, at a speed significantly greater than the rotational speed of the polishing pad, to ensure that the movement of the polishing pad is a very small increment of the cumulative motion between the pad and substrate.

12 Claims, 4 Drawing Sheets

ORBITAL CHEMICAL MECHANICAL POLISHING APPARATUS AND METHOD

BACKGROUND OF THE INVENTION

The present invention relates to the field of chemical mechanical polishing. More particularly, the present invention relates to methods and apparatus for chemical mechanical polishing of substrates used in the manufacture of integrated circuits.

Chemical mechanical polishing is a method of planarizing or polishing semiconductor and other types of substrates. At certain stages in the fabrication of devices on a substrate, it is desirable to polish the surface of the substrate before further processing is performed. One polishing process, which passes a conformable polishing pad over the surface of the substrate to perform the polishing, is commonly referred to as mechanical polishing. This type of polishing may also be performed with a chemical slurry, which typically provides a higher material removal rate and a higher chemical selectivity between films of the semiconductor substrate than is possible with mechanical polishing. When a chemical slurry is used in combination with mechanical polishing, the process is commonly referred to as chemical mechanical polishing, or CMP. In either polishing process, the amount of material removed at any location on the substrate is a direct function of the cumulative movement of the polishing pad over the substrate surface, the pressure at the substrate/polishing pad interface, and the slurry. Where all other factors remain unchanged, the greater the cumulative movement between the substrate and the polishing pad, the greater the amount of material removed from the substrate surface.

One apparatus for polishing substrates that has gained commercial acceptance employs a large platen and polishing pad assembly which is rotated at 60 to 80 r.p.m., and a substrate carrier which holds the substrate and positions the substrate against the large polishing pad. The substrate carrier maintains the substrate in a fixed position on the rotating polishing pad as the rotating pad polishes the desired amount of material off the substrate. Where a rotating polishing pad is used to polish a fixed substrate, the velocity of the polishing pad past a reference point on the fixed substrate, and thus the cumulative motion of the polishing pad past that reference point over any given increment of time, increases as the distance between the reference point and the axis of rotation of the polishing pad increases. Therefore, the cumulative movement between the substrate and the polishing pad will vary across the face of the substrate. Those areas of the substrate which are located further from the rotational axis of the polishing pad experience greater cumulative movement, and therefore greater material removal, than areas of the substrate maintained closer to the rotational axis of the polishing pad.

Numerous types of process equipment have been proposed in an attempt to overcome the problem of differential material removal rates inherent from the use of large rotating polishing pads. One solution to this differential polishing is to rotate the substrate and the polishing pad at the same speed in the same rotational direction. This will ensure equal cumulative movement, and thus equal material removal, over the entire surface of the substrate. However, it is difficult to control the velocities and inertial forces generated in this configuration, and if the relative velocities of the substrate and polishing pad are not closely controlled, the substrates will be non-uniformly polished. Another approach to overcoming the differential polishing inherent with the use of large rotating polishing pads involves vibrating or oscillating the substrate on the rotating pad. One variation of this structure is shown in U.S. Pat. No. 5,232,875, Tuttle, which is incorporated herein by reference, wherein the platen and polishing pad are orbited, i.e., moved about an axis other than their center, and the substrate is placed against the orbiting pad in an attempt to equalize the cumulative motion between the substrate and pad. This structure is difficult to control and maintain, because the orbiting mass of the platen creates substantial undesirable inertial and vibrational forces. The reference also discloses orbiting the substrate against a fixed pad. However, if a substrate were to be orbited against a fixed pad, the area of the pad at which polishing is occurring will quickly compress and slurry will not enter the interface between the substrate and the polishing pad. This will cause the polishing characteristics, including the uniformity of the removal rate of the polishing pad, to become unstable in the area on which the substrate orbits, resulting in unusable polished substrates. The change in polishing characteristics inherent from orbiting a substrate over a fixed pad will also reduce the life of the polishing pad and thus create a requirement for more frequent pad changes, or will create a need to recondition the polishing pad more frequently, both of which result in higher cost per processed substrate to the CMP user.

SUMMARY OF THE INVENTION

The present invention provides methods and apparatus for chemical mechanical polishing of substrates. The invention includes a large polishing pad, which rotates at a relatively slow velocity and receives a substrate thereagainst for polishing. The substrate is moved over the polishing pad in an orbital motion at a relatively fast orbital velocity as compared to the rotational velocity of the polishing pad. By moving the substrate in an orbital motion over a slowly rotating polishing pad, the net relative movement between the polishing pad and substrate at all locations on the substrate is substantially equal, while no substantial pattern is impressed in the polishing pad as the substrate is processed.

BRIEF DESCRIPTION OF THE DRAWINGS

These and other features and advantages of the invention will become apparent from the description of the embodiments, when read in conjunction with the following drawings, wherein.

DESCRIPTION OF THE EMBODIMENTS

Figure 1:
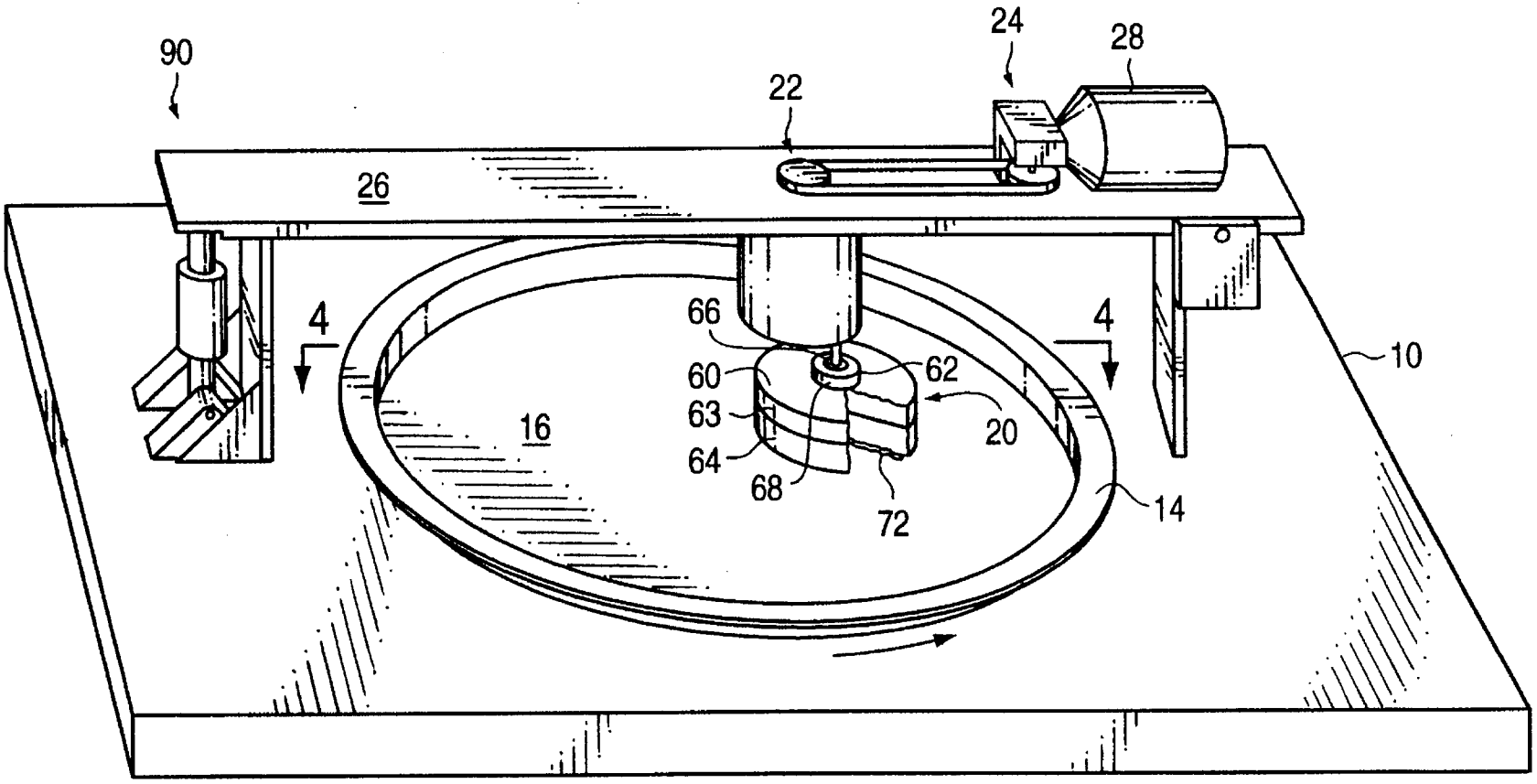
FIG. 1 is a perspective view of the CMP apparatus of the present invention, with the substrate carrier shown in cutaway.

Referring to FIG. 1, a CMP apparatus for polishing substrates is shown. The apparatus includes a base 10 rotatably supporting a large rotatable platen 14 with a polishing pad 16 mounted thereto, a substrate carrier 20 which positions a substrate 72 against the polishing pad 16 for polishing, and a control assembly 22 to move and bias the substrate carrier 20 on polishing pad 16. Polishing pad 16 is preferably a polyeurethane pad available from Rodel of Newark, N.J., and sold under the trade names Suba IV or IC 1000. To limit hydroplaning of the substrate 72 on the polishing pad 16, a plurality of grooves or recesses may be provided in the surface of the polishing pad 16. Control member 22 moves the substrate carrier 20, and thus the substrate 72 held therein, in an orbital path as the polishing pad 16 slowly rotates. That is, the substrate carrier 20 is orbiting about a point but is not rotating, so that the cartesian coordinates of the substrate carrier 20 remain parallel to those on base 10 while any point on the substrate carrier 20 is orbiting. The radius of the orbital path, and the orbital velocity of the substrate carrier 20 are preferably established, with respect to the rotational velocity of the polishing pad 16, so that velocity between the substrate 72 and the polishing pad 16 is 1800 to 4200 cm per minute and the cumulative motion between the substrate 72 and polishing pad 16 is primarily attributable to the orbital motion of the substrate carrier 20. Preferably, the polishing pad 16 rotation contributes less than 5% of the cumulative movement between the substrate 72 and carrier 20. Additionally, to selectively enhance the polishing rate on the substrate surface, slurry having a pH of approximately 10, preferably formulated from approximately 5% KOH and 5% NaOH in a water base, and including colloidal silica with a particle size of approximately 300 nm, is supplied to pad 16 through a slurry port, through holes, slots or grooves in the polishing pad 16, or other slurry delivery means. The slurry is preferably chemically active with at least one material on the substrate, and therefore other slurry compositions, with different reactivities, may be substituted without deviating from the scope of the invention.

Figure 2:
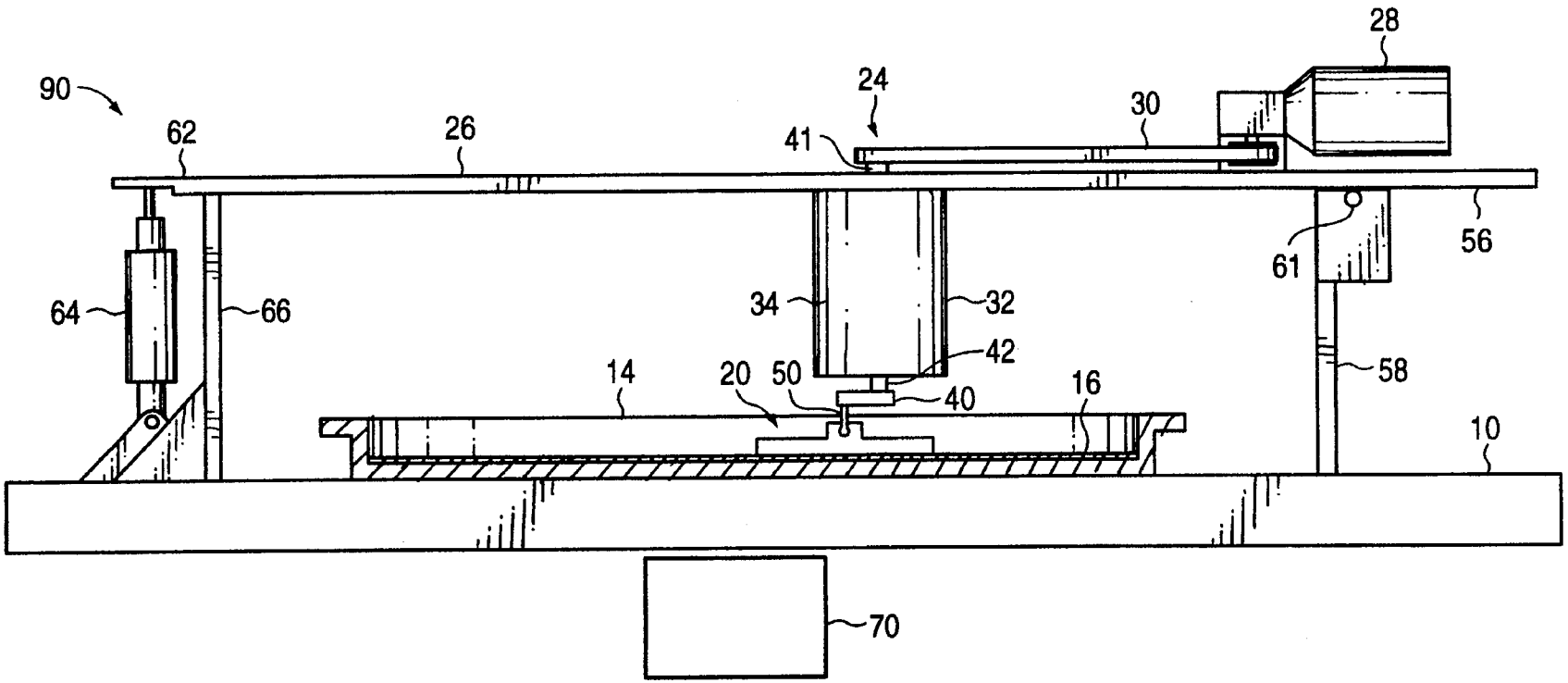
FIG. 2 is an elevational view, partially in section, of the apparatus of FIG. 1.
Figure 3:
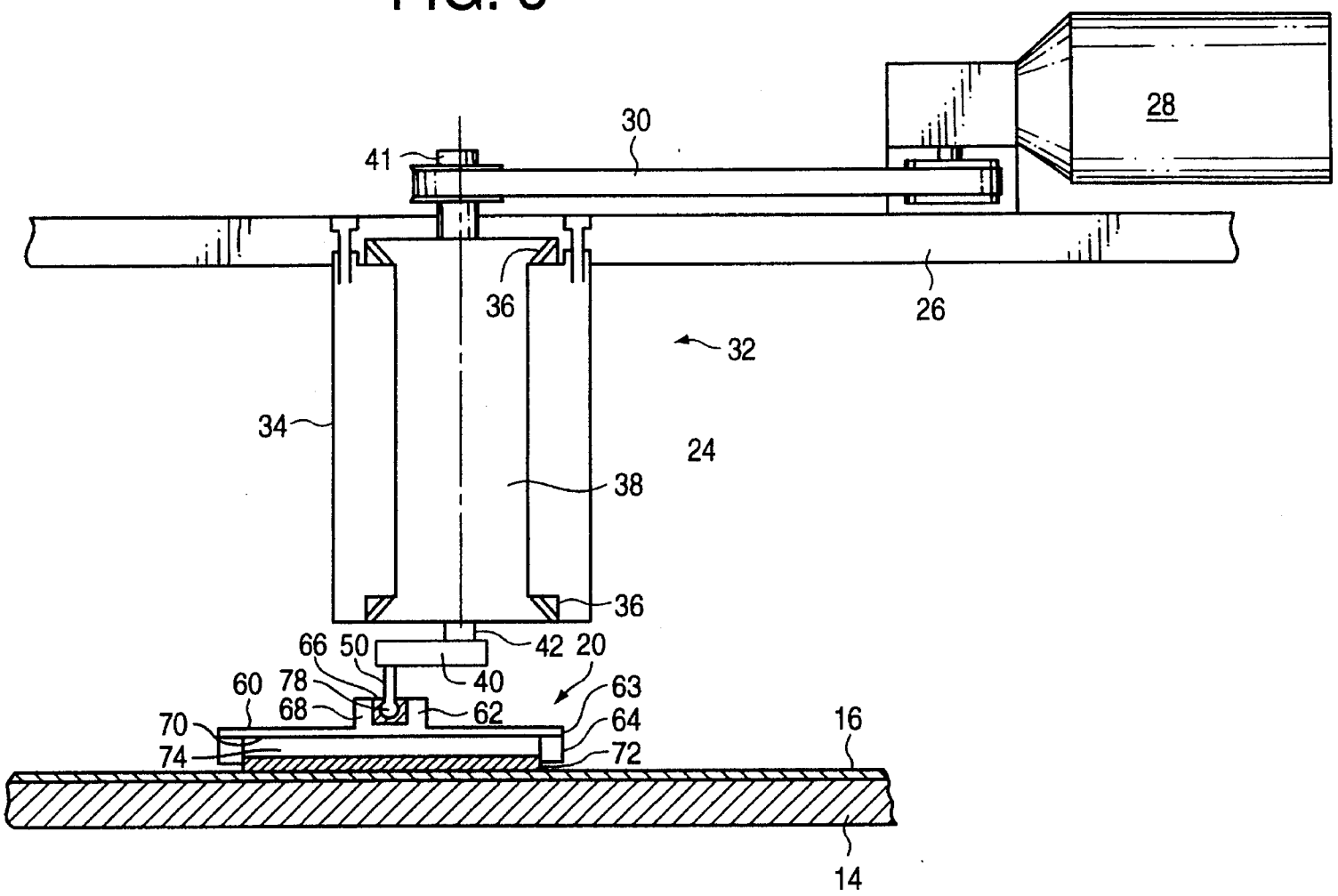
FIG. 3 is a partial enlarged sectional view of the apparatus of FIG. 1.

Referring now to FIGS. 2 and 3, the control assembly 22 includes a drive portion 24 for imparting the orbital motion to the substrate carrier 20, and biasing assembly 90 for controlling the force at the interface of the substrate 72 and the polishing pad 16. Drive portion 24 and biasing assembly 90 together create the rotational and force conditions necessary for polishing a substrate 72 on the polishing pad 16.

Referring particularly to FIG. 3, drive portion 24 includes a drive motor 28 supported on cross bar 26 to supply motion to orbit the substrate carrier 20, and is connected via a drive belt 30 to a transfer case 32 which translates the rotary motion of motor 28 into orbital motion of the substrate carrier 20. To provide this translation, transfer case 32 includes a housing 34 which is secured against rotation to the underside of cross bar 26, and which receives and rotatably supports a spindle 38 therein. The spindle 38 includes an upper shaft 41 extending upwardly through an aperture in the cross bar 26 and terminating in a sheave, and a lower shaft 42 extending from the lower end of spindle 38 outwardly of housing 34. To maintain the spindle 38 within transfer case housing 34, but allow spindle 38 to rotate with respect to the housing 34, the upper and lower ends of the spindle 38 are secured in conical bearings 36. Housing 34 and spindle 38 cooperate to transfer rotary motion from the motor 28 to a location above the substrate carrier 20 received on the polishing pad 16. To translate this rotary motion into orbital motion of the substrate carrier 20, transfer case 32 also includes an offset arm 40. One end of the offset arm 40 is positioned on the lower shaft 42 of spindle 38, and the other end of arm 40 receives a downwardly projecting stem 50. The lower end of stem 50 engages a recess in substrate carrier 20. When spindle 38 rotates, arm 40 sweeps stem 50, and thus the substrate carrier 20 attached thereto, through a circular path centered about spindle 38. The radius of the circular path is equal to the distance on arm 40 between the shaft 42 and the stem 50.

To control the force at the substrate 72/polishing pad 16 interface, control assembly 22 also includes the biasing assembly 90, which controls and imparts a force on the substrate 72 to load the substrate against the polishing pad 16. Referring again to FIG. 2, biasing assembly 90 includes the cross bar 26, which rigidly supports the housing 34 over polishing pad 16, and a pneumatic cylinder 64 which may be differentially energized to supply different loads on the substrate 72. During polishing operations, the preferred load at the interface is 0.3 to 0.7 $Kg/cm^2$. To position cross bar 26 over polishing pad 16 and control the load pressure at the substrate 72/polishing pad 16 interface, one end 56 of cross bar 26 is pivotally connected to an upright 58 at a pivot 61, and the opposite end 62 of cross bar 26 is connected to the variable cylinder 64. A stop 66 is provided adjacent the cylinder 64 to limit the downward motion of end 62 of cross bar 26, to prevent overloading of the transfer case 32 or the substrate carrier 20. Because the drive motor 28 and housing 34 are mounted on the cross bar 26, substantial mass is present to load the substrate 72 against the polishing pad 16. However, the mass of these components is insufficient to cause the load at the interface to equal the preferred load. To increase the load at the interface, cylinder 64 applies a downwardly directed force on end 62 of cross arm 26, and cross arm 26 loads transfer case 32, and thus substrate carder 20, against the polishing pad 16. To control this downwardly directed force on end 62, the fluid pressure within cylinder 64 is controlled. For a given mass of components on cross arm 26, and a given cylinder 64 design, the load at the substrate 72/polishing pad 16 interface corresponding to different cylinder fluid pressures may be predicted and controlled to create the desired load at the substrate 72/polishing pad 16 interface.

Referring again to FIG. 3, substrate carrier 20 is configured to receive a substrate 72 thereon, and orbit the substrate 72 on the polishing pad 16. Substrate carrier 20 includes a generally planer circular body 60 having a generally circular edge 63. An annular projecting sleeve 62 extends upwardly from the center of body 60, and an annular ring 64 is disposed about the underside of body 60 adjacent edge 63. Annular projecting sleeve 62 includes a right circular annular boss 68 which is preferably an integral projecting extension of body 60, and an annular sleeve 66 is received therein. Sleeve 66 is preferably made from a homopolymer acetal resin. Ring 64 extends downwardly from body 60 and forms a cavity 70 for receipt of a substrate 72 therein. The cavity 70 formed in the underside of the substrate carrier 20 holds a conforming pad 74 therein, preferably configured from a buffed polymeric film, which forms a slightly conforming surface against which the substrate 72 is held during processing. Pad 74 is preferably a closed pore material, which-includes open cells at the face thereof, and therefore holds a small amount of slurry or other liquid or air therein during processing. To chuck the substrate 72 to the substrate carrier 20, the substrate 72 is pressed against the pad 74 to slightly compress the pad 74 and grip the substrate 72 thereto by surface tension, or by a vacuum, which is sufficient to maintain the substrate 72 in the substrate carder 20 as the substrate carrier 20 is located onto the polishing pad 16. To ensure that the substrate 72 does not become disengaged from the substrate carrier 20, the ring 64 which forms the cavity 70 extends below the pad 74, but does not extend to the surface of the polishing pad 16. Therefore, the ring 64 is in a position to engage the outer circumferential edge of the substrate 72 if the substrate 72 slips off the pad 74 during processing, while leaving a small gap between the underside of ring 64 and the polishing pad 16 during processing.

To orbit the substrate carrier 20 and a substrate 72 therein, stem 50 of transfer case 32 extends into sleeve 66. To provide a low friction coupling between stem 50 and sleeve 66, the lower terminal end of stem 50 is preferably formed as a spherical head 78. The diameter of head 78 is slightly smaller than the diameter of the annular bore in sleeve 66. Therefore, the contact between sleeve 66 and head 78 will be a point contact at a location within sleeve 66. When spindle 38 is rotated, stem 50 and spherical head 78 thereof sweep through a circular path centered about spindle 38. Spherical, head 78 sweeps sleeve 66, and thus substrate carrier 20 attached thereto, through this same path. Because the spherical head 78 is slightly smaller than the diameter of the bore in sleeve 66, the spherical head 78 moves within sleeve 66 with substantially no friction, and the contact point between head 78 and sleeve 66 moves around the inner diameter of sleeve 66 as spherical head 78 moves through the circular orbital path. Thus, at the contact point between the spherical head 78 and sleeve 66, the contact force which moves the substrate carrier 20 through the circular path is almost entirely linear, and only a very small rotational, non-orbital, component of motion, substantially less than the contribution of the polishing pad 16 motion to the cumulative motion between the substrate 72 and the polishing pad 16, is imparted to the substrate carrier 20 by stem 50.

Figure 4:
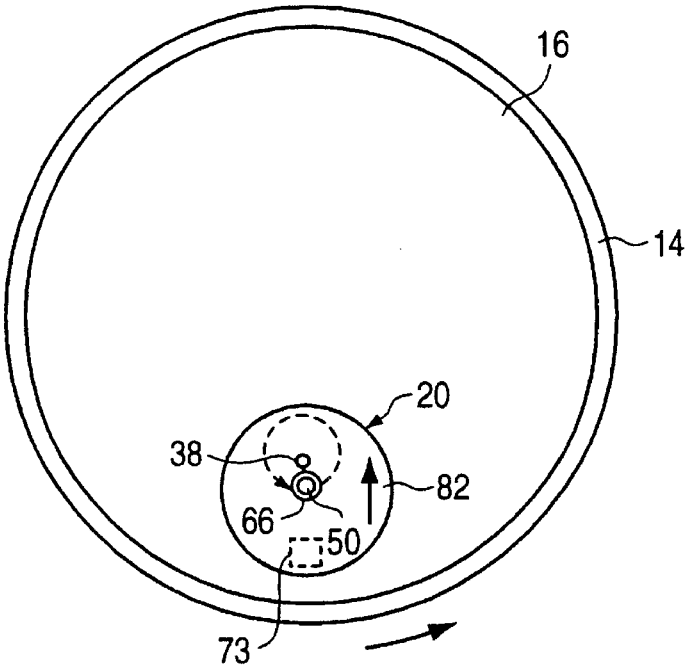
FIG. 4 is a top view of the apparatus of FIG. 1 at section 4—4.
Figure 5:
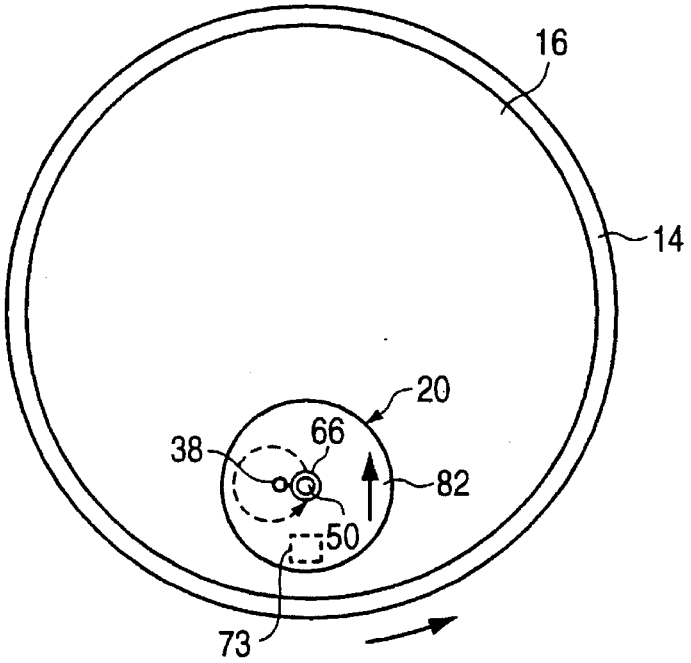
FIG. 5 is an additional top view of the apparatus of FIG. 1 at section 4—4, with the substrate carrier thereof moved through an arc of 90 degrees with respect to the position thereof of FIG. 4.

Referring now to FIGS. 4 and 5, the effect of non-rotational orbiting of the substrate carrier 20 by stem 50 is shown. For ease of illustration, substrate carrier 20 includes an imaginary reference vector 82 thereon. As shown in FIG. 4, motion is imparted to substrate carrier 20 where stem 50 is received in sleeve 66. Stem 50, and thus the center of substrate carrier 20, move in a circular path having a radius defined by the distance between the center lines of stem 50 and spindle 38. As shown in FIG. 5, spindle 38 has moved approximately 90 degrees in a counter-clockwise direction from the position thereof in FIG. 4, which sweeps stem 50, and thus sleeve 66, through 90 degrees of the circular orbit path. Additionally, each point on the substrate 72 therein moves substantially through this same path, because the drive system imparts a minimal rotational element of motion to the substrate 72. As shown in FIG. 5, vector 82 maintains the same orientation as it had in FIG. 4, as substrate 72 and carrier 20 orbit but do not rotate on the circular path. The only rotation which will occur on substrate 72 as it is polished will be primarily created by surface discontinuities or differential friction at the substrate 72/polishing pad 16 interface, which can cause the substrate 72 to slowly rotationally precess as it orbits.

Although the orbital motion of the wafer carrier 20 on pad 16 will create sufficient cumulative motion between the polishing pad 16 and substrate 72 to polish the substrate 72, the polishing pad 16 will take a set if the substrate 72 is moved constantly over the same area, which will affect the rate and uniformity of polishing. Referring again to FIG. 2, to address this problem a motor 70 positioned on the underside of base 10 is coupled, through a reduction gear set and a drive shaft, to the underside of the platen 14. Motor 70 rotates platen 14 and polishing pad 16 at a low rpm, preferably 2 rpm or less. The motor speed is selected to impart a minimal amount of rotational component to the cumulative motion between the substrate 72 and the polishing pad 16, while simultaneously moving the polishing pad 16 quickly enough to prevent undue compression on the polishing pad 16 where the substrate 72 engages the polishing pad 16. It is preferred that the motion at the substrate 72/polishing pad 16 interface attributable to the rotation of polishing pad 16 be less than 10%, and more preferably, less than 5%, of the cumulative motion at that location. For example, where carrier 20 orbits a 200 mm substrate at 270 orbits per minute in a 2.5 cm radius orbit, and the polishing pad 16 has a diameter of 600 cm and rotates at less than 1 rpm, the contribution of the rotational movement of the pad 16 to the total movement at the substrate 72/polishing pad 16 interface is less than 5% of the cumulative movement anywhere on the substrate 72/polishing pad 16 interface. In this example, the velocity of the substrate 72 attributable to orbital motion is approximately 4000 cm/min, and the maximum velocity attributable to the motion of the polishing pad 16 is approximately 180 cm/min. Additionally, it is preferred that the substrate 72 orbit in a radius substantially less than the radius of the substrate 72, to reduce the magnitude of inertial forces generated in the CMP apparatus, and even more preferable that the substrate orbit about a radius equal or less than the edge dimension of a die on the substrate, or example as can be seen in FIGS. 4 and 5, a die (IC chip or device) 73 on the surface of the substrate 72, can have a die edge dimension of 3 mm and the substrate orbits in a 3 mm radius at an orbit speed of approximately 2000 orbits per minute and the polishing pad rotates at 1 rpm, the percentage of contribution of cumulative movement attributable to the polishing pad is less than 5% of the total movement between the polishing pad 16 and substrate 72. By further reducing the rotational velocity of the polishing pad to one-fifth of a revolution per minute the contribution of the polishing pad 16 is reduced to less than 1% of the cumulative movement. It will be understood that those portions of the substrate 72 which are maintained further from the center of the polishing pad 16 will receive a greater contribution to their cumulative movement from the polishing pad 16 than will those areas of the substrate 72 maintained closer to the center of the polishing pad 16. In the disclosed embodiment, the restriction on the radius of the substrate implies that the length of the offset arm 40 is less than radius of a circular substrate. Although the contribution of the polishing pad 16 to the cumulative movement of the substrate over the pad is preferably less than 10%, percentages as high as 25% partially provide the advantages of the invention. Additionally, by varying the orbital velocity of the substrate 72, independently of or in conjunction with changes in the rate of movement of the polishing pad 16, substantial variation in the relative velocity between the polishing pad 16 and the substrate 72, and in the relative contributions to that motion by the rotational motion of the polishing pad 16, may be easily varied.

By orbiting the substrate 72 over a slowly moving polishing pad 16, and ensuring that only a very small portion of the cumulative motion between the polishing pad 16 and the substrate 72 is contributed by the motion of the polishing pad 16, each point on the substrate 72 will receive substantially equal cumulative motion, and therefore the amount of material removed from different areas of the substrate 72 will be substantially equal. Although a preferred embodiment for supplying this motion is shown, the invention may be used in other configurations without deviating from the scope of the invention. For example, the orbital motion may be directly imparted by motor 28, other sizes of substrates 72 and polishing pads 16 may be used, and the polishing pad 16 and substrate 72 may move in opposite directions. Additionally, the relative velocities of rotation may be varied, dependant upon the criticality of the polishing rate across the surface of the substrate 72, the sizes of the polishing pad 16 and the substrate 72, and the load at the substrate 72/polishing pad 16 interface.

We claim:

1. A method of polishing a substrate, comprising the steps of:

engaging a substrate having a die thereon with a carrier to press the substrate against a surface of a polishing pad and to prevent the substrate from sliding out from between the carrier and the surface of the polishing pad when there is relative motion between the carrier and the surface of the polishing pad;

rotating the polishing pad at a rotation rate to provide a rotating polishing pad contribution to the total rate of relative motion between the substrate and the polishing pad; and moving the substrate in an orbital path at an orbit rate substantially greater than the rate of rotation of the polishing pad to provide a substrate orbit contribution to a total rate of relative motion between the substrate and the polishing pad, wherein the radius of the orbit path is smaller than an edge dimension of said die.

2. A method as recited in claim 1, wherein said step of moving the substrate causes minimal rotation of said substrate.

3. A method as recited in claim 1, wherein the rotating polishing pad contribution to the total rate of relative motion between the substrate and the polishing pad is 10% or less of the total rate of relative motion between the substrate and the polishing pad.

4. A method as recited in claim 1, wherein the rotating polishing pad contribution to the total rate of relative motion between the substrate and the polishing pad is 5% or less of the total rate of relative motion between the substrate and the polishing pad.

5. A method as recited in claim 1, wherein the rotating polishing pad contribution to the total rate of relative motion between the substrate and the polishing pad is 1% or less of the total rate of relative motion between the substrate and the polishing pad.

6. An apparatus for polishing a substrate, comprising:

a rotating polishing pad;

a carrier engaging the substrate to press the substrate against a surface of the polishing pad and prevent the substrate from sliding out from between the carrier and surface of the polishing pad when there is relative motion between the carrier and the surface of the polishing pad; and a drive member interconnected to said carrier to provide an orbital motion to said carrier;

wherein said drive member orbits said carrier at an orbit rate substantially greater than the rate of rotation of said polishing pad; and wherein the substrate has at least one die thereon, and the radius of an orbit of said orbital motion is smaller than an edge dimension of said die.

7. The apparatus of claim 6, wherein said polishing pad is received on a rotatable platen.

8. The apparatus of claim 6, wherein said polishing pad rotates at less than 2 r.p.m.

9. The apparatus of claim 8, wherein said carrier orbits at a speed in excess of 250 orbits per minute.

10. The apparatus of claim 6, wherein the contribution to the cumulative rate of relative motion between the polishing pad and the substrate attributable to the rotational motion of the polishing pad is less than 1% of the total cumulative rate of relative motion between the substrate and polishing pad.

11. The apparatus of claim 6, wherein said polishing pad rotates about a first axis of rotation, and said carrier orbits about a second axis of rotation offset from the first axis of rotation so that the orbital path of the substrate does not cross said first axis of rotation.

12. The apparatus of claim 6 wherein said drive member interconnected to said carrier includes a central shaft fixed to an offset arm, an end of the offset arm being connected to a center of said carrier such that rotation of the central shaft provides the orbital motion to said carrier.

* * * * *